United States Patent [19]

Baylor

[11] Patent Number: 4,793,551

[45] Date of Patent: Dec. 27, 1988

[54] STORAGE MAIL BOX

[76] Inventor: Jack W. Baylor, 1094 Fairview Dr., Paradise, Calif. 95969

[21] Appl. No.: 166,406

[22] Filed: Mar. 10, 1988

[51] Int. Cl.[4] ..... B65D 91/00

[52] U.S. Cl. ..... 232/17; 232/39; 232/45

[58] Field of Search ..... 232/17, 31, 32, 38, 232/39, 15, 16, 45, 47

[56] References Cited

U.S. PATENT DOCUMENTS

| | | | |
|---|---|---|---|
| 2,964,237 | 12/1960 | Henderson | 232/16 |
| 3,171,591 | 3/1965 | Long et al. | 232/16 X |
| 3,880,344 | 4/1975 | Earle | 232/17 |
| 4,367,844 | 1/1983 | Drummond | 232/17 |
| 4,498,621 | 2/1985 | Diamond | 232/17 X |
| 4,724,999 | 2/1988 | Fitzgerald et al. | 232/17 |

*Primary Examiner*—Robert W. Gibson, Jr.
*Attorney, Agent, or Firm*—Leon Gilden

[57] ABSTRACT

A storage mail box is set forth wherein a conventional rural type mail box is formed with a hingeably mounted false floor including an overlying hingedly mounted door is positionable in a first position overlying an opening in said false floor and pivotal to a second position securable to a wall of the mail box to provide access to the false floor. The false floor includes a directed chute wherein the chute is angulated and oriented to direct mail positioned within the mail box into a central hollow support post wherein the mail drops to enable selective access through a rear locked access door of the post.

7 Claims, 1 Drawing Sheet

STORAGE MAIL BOX

BACKGROUND OF THE INVENTION

1. Field of the Invention

The field of invention relates to mail boxes and more particularly relates to a new and improved rural type mail box provided with a false floor directing mail through a selectively movable and hingedly mounted door to enable mail to drop into an associated hollow post wherein such mail may be selectively accessed through a rear lockable door.

2. Description of the Prior Art

The use of mail box apparatus is well known in the prior art. As may be appreciated, there are various mail boxes for use for various purposes, such as distinguishing between residential and commercial use in terms of capacity and convenience for a postal delivery service. Mail boxes of the prior art have included apparatus incorporating special features to enhance a particular need of a user of the associated mail box. For example, U.S. Pat. No. 1,506,646 to Kolstad illustrates the use of a mail box formed with an underlying directed conduit for positioning within a wall of a building to enable directing of mail from exteriorly of said building to an interior access door. While being an effective solution to delivering mail internally of a building through a wall structure, the Kolstad patent does not provide any means for the selective storage of mail within a hollow support post.

U.S. Pat. No. 2,405,730 to Bankson provides a mail box to uniformly stack letter mail in a desired orientation within a compartment underlying an opening in the mail box and is of interest relative to the instant invention in the general structural orientation of an overlying chute and an underlying mail storage compartment, but in essence is of a structure an function remote from the instant invention.

U.S. Pat. No. 3,735,919 to Morgan provides a plurality of doors, one overlying the other, wherein the underlying doors provided with a latch mechanism to provide selective access thereto. The overlying door is coordinated involving a cam mechanism to lift a trap door upon opening of the upper compartment to enable deposit of mail into the lower compartment. While an effective organization, the Morgan patent is of a relatively complex and awkward structure, as opposed to the instant invention.

U.S. Pat. No. 3,880,344 to Earie wherein a pivotal door located medially in an upper deposit chamber when returned to an upright position deposits mail into a lower chamber. The Earie patent does not provide selective use of a storage compartment in association with a hollow support post, as opposed to the instant invention which simplifies and eases the use of a storage mail box organization.

U.S. Pat. No. 4,186,869 to Brown sets forth a rectangular post wherein a letter box is pivotal at an uppermost portion of the rectangular housing to enable deposit of mail to an underlying part of said housing. Associated weights are operable in conjunction with the letter box to normally close the letter box when not in use to avoid introduction of unwanted foreign matter therein.

As such, it may be appreciated that there is a continuing need for a new and improved storage mail box which addresses both the problem of simplicity and effectiveness, and in this respect, the present invention substantially fulfills this need.

SUMMARY OF THE INVENTION

In view of the foregoing disadvantages inherent in the known types of storage mail boxes now present in the prior art, the present invention provides a storage mail box wherein the same may be selectively utilized as a conventional rural mail box and can be further easily and efficiently manipulated to provide a storage mail box to house letters within a central hollow support post when desired. As such, the general purpose of the present invention, which will be described subsequently in greater detail, is to provide a new and improved storage mail box which has all the advantages of the prior art storage mail boxes and none of the disadvantages.

To attain this, the present invention comprises a storage mail box formed with a generally elongate housing and a false floor hingedly mounted to a side of the mail box. When desired, the false floor may be manipulated into an upward locked position secured proximate a wall of the mail box to uncover a chute to direct mail into a central hollow support post formed with a locking access door to enable access to mail stored within the hollow post.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved storage mail box which has all the advantages of the prior art storage mail boxes and none of the disadvantages.

It is another object of the present invention to provide a new and improved storage mail box which may be easily and efficiently manufactured and marketed.

It is a further object of the present invention to provide a new and improved storage mail box which is of a durable and reliable construction.

An even further object of the present invention is to provide a new and improved storage mail box which is susceptible of a low cost of manufacture with regard to both materials and labor, and which accordingly is then susceptible of low prices of sale to the consuming public, thereby making such storage mail box economically available to the buying public.

Still yet another object of the present invention is to provide a new and improved storage mail box which provides in the apparatuses and methods of the prior art some of the advantages thereof, while simultaneously overcoming some of the disadvantages normally associate therewith.

Still another object of the present invention is to provide a new and improved storage mall box wherein the same is provided with a trap door to enable access to a chute directing mail into a central hollow support post.

Yet another object of the present invention is to provide a new and improved storage mail box wherein a lockable access door is formed to the hollow post to enable selective access thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
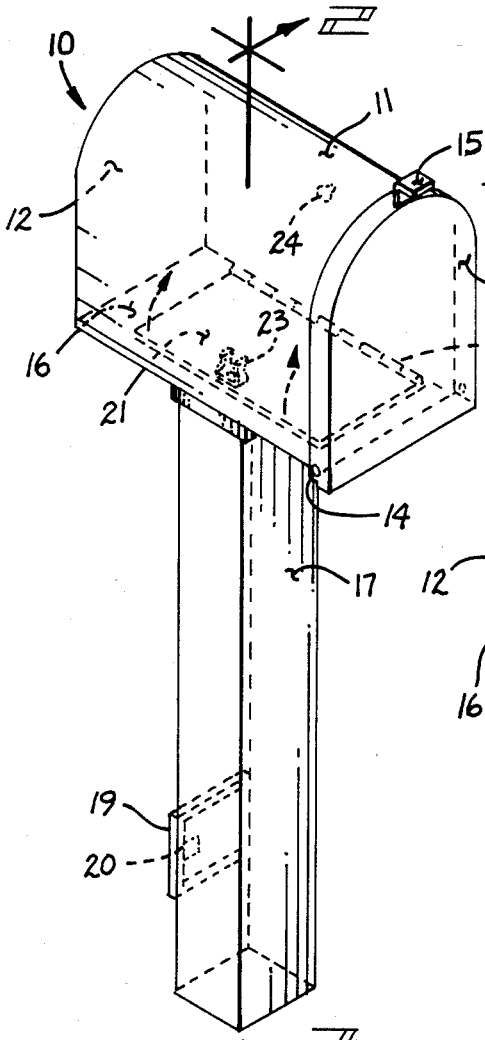
FIG. 1 is an isometric illustration of the storage mail box of the instant invention.
Figure 2:
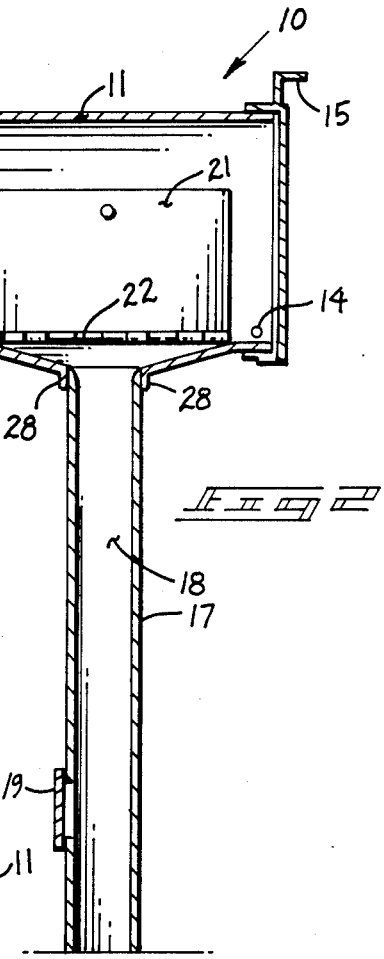
FIG. 2 is an orthographic cross-sectional view taken along the lines 2—2 of FIG. 1 in the direction indicated by the arrows.
Figure 3:
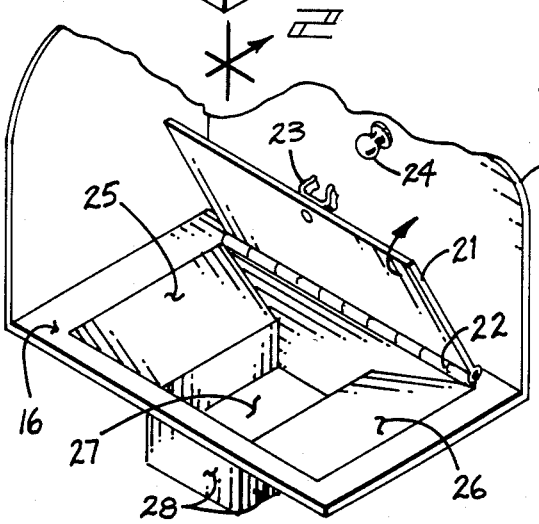
FIG. 3 is a sectional isometric illustration somewhat expanded illustrating the trap door providing access to the storage facility of the instant invention.

With reference now to the drawings, and in particular to FIGS. 1 to 3 thereof, a new and improved storage mail box embodying the principles and concepts of the present invention and generally designated by the reference numeral 10 will be described.

More specifically, it will be noted that the storage mail box 10 essentially comprises a housing formed with a generally "U" shaped exterior side wall 11 with an integrally secured end wall 12 affixed thereto. It is to be understood side wall 11 may be formed on a myriad of configurations consistent with the teachings of the instant invention. A forwardly mounted housing access door !3 is pivotally secured to the exterior side wall 11 by use of a first hinge 14. A handle 15 secured at an uppermost portion of access door 13 is of conventional configuration to provide a manual gripping surface for the opening and closing of the noted access door 13.

A floor 16 is integrally formed to the exterior side wall 11 and end wall 12 and secured to an underlying hollow post 17. The hollow post 17 is formed with a storage channel 18 to accept mail directed thereto and is provided with sufficient volume to accept a considerable quantity of mail over an extended period of time.

A post access door 19 is formed proximate a lower end of the post 17 which in turn secured to the ground or desired structure to prevent unauthorized removal of the storage mail box 10. The post access door 19 is formed with a lock mechanism 20 of conventional design to enable selective access to the interior of the hollow post 17. Pivotally mounted to the floor 16 is a false floor or trap door 21 formed with a second hinge to enable pivoting motion of the trap door 21 in the direction indicated by the arrows of FIGS. 1 and 3. A spring finger latch mechanism 23 is secured proximate an upper terminal edge of the trap door 21 and cooperates with a latch knob 24 to enable seducement of the trap door 21 and fastening thereto to the side wall 11 when it is desired to permit and direct mail to the storage channel 18 of hollow post 17.

Integrally secured to the floor 16 is a rear inclined wall 25 and a forward inclined wall 26 to direct mail to a mounting duct 27 oriented orthogonally to floor 16 and formed of flanges 28 to define duct 27 and permit mounting thereof to the hollow post 27 by selective fastening mechanisms, such as adhesives, mechanical fasteners, and welding. The span between the joining of rear inclined wall to floor 66 to the juncture of forward inclined wall 26 to floor 16 defines a delivery chamber of a length and width substantially equal to trap door 21.

As to the manner of usage and operation of the present invention, the same should be apparent from the above description, but a brief discussion for purposes of summation is set forth. In a first or lower position, as illustrated in FIG. 1, the storage mail box 10 functions as any typical rural mail box does to accept mail introduced through the housing access door 13 and deposited overlying the floor 16 and trap door 21. Should the users of the storage mail box 10 desire security due to their prolonged absence or to protect certain mail delivered to the storage mail box !0, the trap door 21 is merely pivoted to the second position to enable engagement of the spring finger mechanism 23 with the latch knob 24 secured to the side wall 11 whereupon depositing of mail within the mail box 10 will be directed downwardly along the forward and rear inclined walls 26 and 25 and through the duct 27 and deposited within the hollow post 17 in storage channel 18 to enable selective access thereto through the access door 19, as desired.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A storage mail box apparatus for receiving mail comprising a horizontally oriented housing including an elongate side wall means integrally secured to a floor means and a rear end wall for defining a chamber with a forward housing access door pivotally mounted to said side wall means;

said floor means including a planar floor with a trap door pivotally mounted to said floor overlying a delivery chamber mounted to a hollow post;

said hollow post formed with a post access door proximate a lower end thereof remote from said delivery chamber wherein said lower end is fixedly securable to a support.

2. A storage mail box apparatus as set forth in claim 1 wherein said trap door is hingedly mounted to said floor with an elongate hinge.

3. A storage mail box apparatus as set forth in claim 2 wherein said delivery chamber is defined by a forward and rear inclined wall to downwardly direct said mail wherein said forward and rear inclined wall are integrally secured to said floor means and wherein said forward and rear inclined wall terminate in a rectangular mounting duct for securement to said hollow post.

4. A storage mail box apparatus as set forth in claim 3 wherein said trap door is defined by a length and width to substantially equal that of said delivery chamber.

5. A storage mail box apparatus as set forth in claim 4 wherein said trap door has secured thereto a spring finger latch mechanism to cooperate with a protruding latch knob secured interiorly of said elongate side wall means to enable said trap door to remain in secure position proximate said elongate side wall means removed from said floor means.

6. A storage mail box apparatus as set forth in claim 5 wherein said hollow post is orthogonally secured to said delivery chamber.

7. A storage mail box apparatus as set forth in claim 6 wherein said post access door is formed with a lock mechanism to enable locking of said post access door to said hollow post.

* * * * *